United States Patent [19]

Sauer et al.

[11] 3,948,147

[45] Apr. 6, 1976

[54] HYDRAULIC SYSTEM WITH AIR-VENTING ARRANGEMENT

[75] Inventors: Ivan Sauer, Schweiberdingen; Manfred Rasper, Leonberg-Silberberg, both of Germany

[73] Assignee: Robert Bosch G.m.b.H., Stuttgart, Germany

[22] Filed: Jan. 10, 1973

[21] Appl. No.: 322,502

[30] Foreign Application Priority Data

Feb. 12, 1972 Germany ..... 2206765

[52] U.S. Cl. ..... 91/442; 91/468; 137/117; 137/197; 137/519.5; 417/299; 417/435

[51] Int. Cl.[2] ..... F15B 13/00

[58] Field of Search ..... 137/199, 533.11, 519.5, 137/117, 199, 101; 60/478, 453, 494, 459; 417/435, 299; 91/442, 468

[56] References Cited

UNITED STATES PATENTS

| | | | |
|---|---|---|---|
| 1,159,518 | 11/1915 | Maul | 137/519.5 |
| 1,934,758 | 11/1933 | Temple | 137/117 X |
| 2,635,620 | 4/1953 | Deardorff | 60/453 |
| 2,684,684 | 7/1954 | Stevenson | 137/199 |
| 2,865,397 | 12/1958 | Chenault | 137/501 X |
| 2,978,987 | 4/1961 | Bessiere | 417/299 |
| 3,081,788 | 3/1963 | Lewis | 137/199 X |
| 3,410,296 | 11/1968 | Bering | 137/199 |

FOREIGN PATENTS OR APPLICATIONS

| | | | |
|---|---|---|---|
| 1,186,504 | 2/1959 | France | 417/299 |
| 801,282 | 12/1950 | Germany | 417/299 |

*Primary Examiner*—Carlton R. Croyle
*Assistant Examiner*—Edward Look
*Attorney, Agent, or Firm*—Michael J. Striker

[57] ABSTRACT

A source of hydraulic fluid is connected with a user by a hydraulic circuit in which a pump is interposed so as to supply the hydraulic fluid under pressure to the user. A housing is interposed in the circuit, having a bore communicating with the circuit. An air venting passage communicates with the bore and a valve body is located in the bore upstream of the passage and defines a throttling gap through which air in the circuit can pass into and out of the passage, but at which subsequent flow of hydraulic fluid will create sufficient pressure to displace the valve body to a position in which it seals the air venting passage.

3 Claims, 3 Drawing Figures

HYDRAULIC SYSTEM WITH AIR-VENTING ARRANGEMENT

BACKGROUND OF THE INVENTION

The present invention relates generally to a hydraulic system, and more particularly to a hydraulic system with an air-venting arrangement.

It is hardly necessary to emphasize that the proper operation of hydraulic systems is most disadvantageously influenced if air is permitted to enter and remain in the hydraulic circuit. Of course, the entry of air into such a circuit is often unavoidable. In such a circumstance, however, it is most important that the air which has entered be vented. The various types of pumps used for moving the hydraulic fluid in the circuit, for instance gear pumps or the like, are not able — due to the gaps between the pump housing and the impellers used — to so compress the entrapped air that it can overcome the closing pressure of a one-way valve incorporated in the circuit or to actuate the user; the result, if the air is allowed to remain, would be that after a short period of time the pump would become inoperative.

Of course, the problem of venting entrapped air from a hydraulic system is not new and attempts have been made to provide appropriate arrangements for this purpose. It is frequently customary to provide at an appropriate point of the hydraulic circuit a venting screw which is loosened when venting is to take place, for instance when the pump for the hydraulic fluid is first started up. After the pump has been operated briefly and it is certain that the entrapped air has been expelled from the circuit by the advancing hydraulic fluid, the screw is tightened again. This is a quite effective and reliable manner of venting a hydraulic system, but evidently it is also a time consuming and rather cumbersome procedure, especially when it is considered that the procedure must be repeated each and every time air has entered the system, for instance each and every time the pump is started up after having been stopped.

A somewhat improved arrangement known from the art utilizes a venting valve which is so accommodated in a hydraulic system that entrapped air can enter into a chamber of a valve housing. A differential-pressure slide is accommodated in the chamber and, when the pressure increases in the system, the slide is displaced so that it closes the chamber and compresses the air which has been trapped therein. In a certain position the slide opens a passage through which the entrapped air can then vent to the atmosphere. When the pressure in the system decreases, the slide returns to its starting position.

This arrangement, also, is possessed of disadvantages of which the most important is the fact that when a larger quantity of air is to be allowed to escape, it is necessary to mechanically push the slide inwardly into the housing (after first removing a protective cap) until the air has been displaced by the advancing hydraulic fluid. Evidently, this is a relatively complicated construction and also time consuming operation, so that this proposal still is far from satisfactory.

SUMMARY OF THE INVENTION

Accordingly, it is a general object of the present invention to provide, in a hydraulic system, an improved arrangement for the venting of entrapped air.

More particularly it is an object of the present invention to provide an improved hydraulic system provided with such an air-venting arrangement.

Another object of the invention is to provide such an improved hydraulic system in which the air-venting arrangement will operate completely automatically without requiring any manual operations.

In keeping with these objects, and with others which will become apparent hereafter, one feature of the invention resides in a hydraulic system, comprising a source of hydraulic fluid, a user, and a hydraulic circuit connecting the source with the user. A pump is interposed in the circuit for supplying hydraulic fluid under pressure from the source to the user.

In accordance with the invention, there is further provided venting means for venting air entrapped in the circuit, and this venting means comprises a housing having a bore interposed in and constituting part of the circuit intermediate the pump and the user. An air passage communicates with this bore and with the ambient atmosphere, and a valve body is normally located in this bore upstream of the passage and is movable to a sealing position closing the passage. The valve body defines in the bore a throttling gap through which entrapped air can pass into the passage but at which sufficient pressure develops, in response to the subsequent flow of hydraulic fluid, for the valve body to become displaced to the sealing position thereof.

A system so constructed is particularly simple, especially with respect to the construction of the venting means, and of course the simpler the construction the less likely it will be to malfunction. Thus, the system according to the present invention will reliably afford an automatic venting of entrapped air from the system and, moreover, it has been found that it will provide for a highly effective venting of the air.

It is particularly advantageous if the valve body is a spring-loaded control slide member with a channel provided with the throttling gap, which slide member in the starting position connects the user with the source of hydraulic fluid and which, due to the pressure loss at the throttling gap, is so displaced by the hydraulic fluid advanced by the pump that the return flow to the source is blocked.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
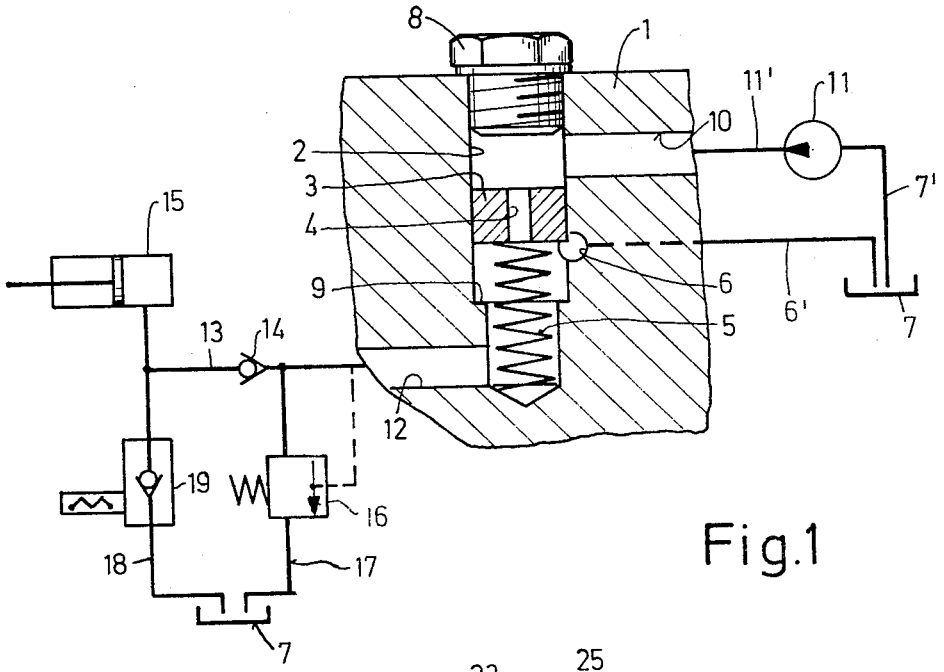
FIG. 1 illustrates a first embodiment of the invention, partly in section and partly illustrated diagrammatically.

Discussing the drawing now in detail, and referring firstly to the embodiment illustrated in FIG. 1, it will be seen that in this Figure reference numeral 1 identifies a valve housing which is only partly shown, because only a partial illustration is necessary for an understanding of the invention. The housing 1 is provided with a stepped bore 2, in the larger-diameter portion of which a cylindrical valve body 3 is slidably accommodated; the valve body 3 seals the bore and is provided with an axial channel 4 whose cross sectional dimension is evidently merely a fraction of that of the bore 2. At one axial side of the valve body 3, at the downstream side as seen with respect to the fluid flow to the user of the hydraulic system, there is provided a biasing spring 5 which abuts against the bottom of the bore 2 and against the valve body 3, normally biasing the latter to a position in which it does not block an airventing passage 6 which communicates with the bore and with the ambient atmosphere. In particular, the spring 5 is located at least in part in the smaller-diameter portion of the stepped bore 2, whereas the valve body is located in the larger-diameter portion thereof with which also the passage 6 communicates. The passage 6 is connected via a conduit 6' with a reservoir 7 for hydraulic fluid. The outer open end of the passage 2 is closed by a closure screw 8 which could of course be replaced by another appropriate closing element. A shoulder 9 at the junction of the larger and smaller diameter portions of the stepped bore 2 provides an abutment limiting the movement of the valve body 3 counter to the action of the spring 5.

A further bore 10 communicates with the bore 2 intermediate the screw 8 and the valve body 3 and is connected with a fluid line 11' which receives hydraulic fluid under pressure from the pump 11, the latter in turn drawing hydraulic fluid from the reservoir 7 via the suction conduit 7'. The smaller-diameter portion of the stepped bore 2 communicates with an additional bore 12 which is connected with a pressure conduit 13 leading to the user, with the user here being a single-acting hydraulic piston 15. Interposed in the conduit 13 is a one-way valve 14. A conduit 17, having interposed in it a pressure limiting valve 16, connects the conduit 13 with the reservoir 7. Pressure fluid leaving the cylinder 15 passes through a return flow conduit 18 to the reservoir 7; an electromagnetically operable one-way valve 19 is interposed in the conduit 18.

It will be appreciated that with this system, when the pump 11 is started up, especially when the system is operated for the first time, the pump will first advance air entrapped in the circuit, and in particular it will draw air from the suction conduit 7' and advance it through the conduit 11' into the bore 10 from where it enters into the bore 2. In the bore 2 the air can pass through the throttling channel 4 and can vent via the passage 6 and conduit 6'. Once the air has been thus displaced the hydraulic fluid following it into the passage 10 and into the bore 2 will encounter the throttling action provided by the channel or passage 4, with the result that sufficient pressure will develop upon the valve body 3 to displace the same counter to the biasing force of the spring 5 until it sealingly closes the air venting passage 6 and moves into abutment with the shoulder 9. The hydraulic fluid passes through the throttling gap or channel 4 and via the bore 12 and the one-way valve 14 into the pressure conduit 13 from where it enters the user 15. To restore the piston of the user 15 to its starting position the valve 19 is operated electromagnetically, permitting the flow of pressure fluid from the user 15 through the conduit 18 back into the reservoir 7.

It is quite clear that, with this construction, automatic venting of all entrapped air in the circuit will have occurred by the time the valve body 3 moves to the position in which it seals the air venting passage 6. Before the valve body 3 reaches this position, that is moves into abutment with the shoulder 9, small quantities of the hydraulic fluid will pass through the throttling gap 4 and the passage 6 back into the reservoir 7. However, this is not in any way disadvantageous because it does not prevent the expulsion of the entrapped air and it does not represent a loss of hydraulic fluid because the fluid will merely be collected again in the reservoir 7.

When the pump 11 is shut down, an equalization of pressure will occur in the bore 2 upstream and downstream of the valve body 3, so that the latter can now be displaced by the biasing spring 5 to its starting position which is shown in FIG. 1, thereby again exposing the passage 6. Advantageously, the orientation of the passage 6 should be such that when this takes place, hydraulic fluid will not flow out of the bore 2 back into the reservoir 7, because this would permit the renewed entry of air which would subsequently have to be expelled again.

Figure 2:
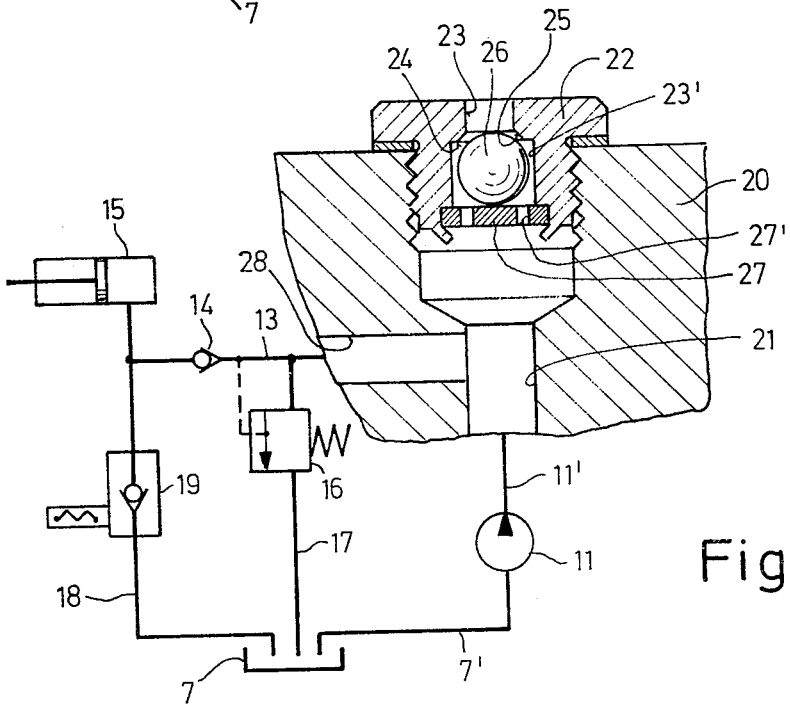
FIG. 2 is a view similar to FIG. 1 illustrating a second embodiment of the invention.

The embodiment illustrated in FIG. 2 is a somewhat simplified version of the embodiment in FIG. 1 and like reference numerals have been used to designate like components.

The valve housing is here identified with reference numeral 20 having a stepped bore 21, the open end of which is closed by a closure screw 22. The closure screw 22 is provided with a stepped bore 23, 23' which extends through the same in axial direction. A shoulder 24 is defined at the junction of the differential-diameter portions 23, 23' of the bore in the screw 22, and this shoulder serves as a valve seat 25 for a valve body which is here configurated as a spherical member 26. The member 26 is located in the larger-diameter portion 23' of the bore and normally rests under the influence of gravity on an apertured plate 27 having apertures 27' therein. The plate 27 extends across the portion 23' of the stepped bore and is sufficiently spaced from the valve seat 25 so that the valve body 26 — when it rests on the plate 27 — is out of engagement with the valve seat 25 and defines with the same an annular throttling gap. The plate 27 is secured in suitable manner in the closure screw 22, for instance by upsetting portions of the material of the screw as shown.

The bore 21 is in communication with the pressure side of the pump 11 via the conduit 11', and it is in communication via a bore 28 and the conduit 13 with a user, here again illustrated as a single-acting hydraulic cylinder and piston unit 15. In all other respects the embodiment of FIG. 2 corresponds to that of FIG. 1.

When, in the embodiment of FIG. 2, the pump 11 is started up, especially when the hydraulic system is put into operation for the first time, then the pump 11 will first draw air through the suction conduit 7' and advance it via the conduit 11' into the bore 21 under the influence of the hydraulic fluid which is subsequently being drawn from the reservoir 7. The air which has now been displaced into the bore 21 passes through the apertures 27' of the plate 27, around the spherical valve body 26 and out through the throttling gap defined between the same and the valve seat 25. The subsequently flowing hydraulic fluid, however, encounters so much flow resistance in the throttling gap between the spherical valve body 26 and the wall bounding the bore 23, that it presses the valve body 26 against the valve seat 25, whereby the bore 23 is sealed. Here, again, it is of no consequence if small quantities of pressure fluid can escape through the bore 23 before the valve body 26 has moved to sealing position, because the bore 23 is in communication via an appropriate conduit with the reservoir 7 so that any escaping pressure fluid will be collected.

Once the valve body 26 has sealed the bore 23, the pressure fluid flows via the conduit 13 and the one-way valve 14 to the cylinder 15, the piston of which performs its stroke. To return the piston to its starting position the pump 11 is switched off and the one-way valve 19 is opened electromagnetically, so that the pressure fluid can flow from the cylinder 15 back into the reservoir 7.

When the pump 11 is shut down, pressure in the bores 21 and 28 can drop sufficiently due to leakage, for the spherical valve body 26 to move out of engagement with the valve seat 25. The screw 22 is advantageously so arranged that when this occurs the entry of air via the bore 23 into the bores 21 and 28 will be prevented.

Figure 3:
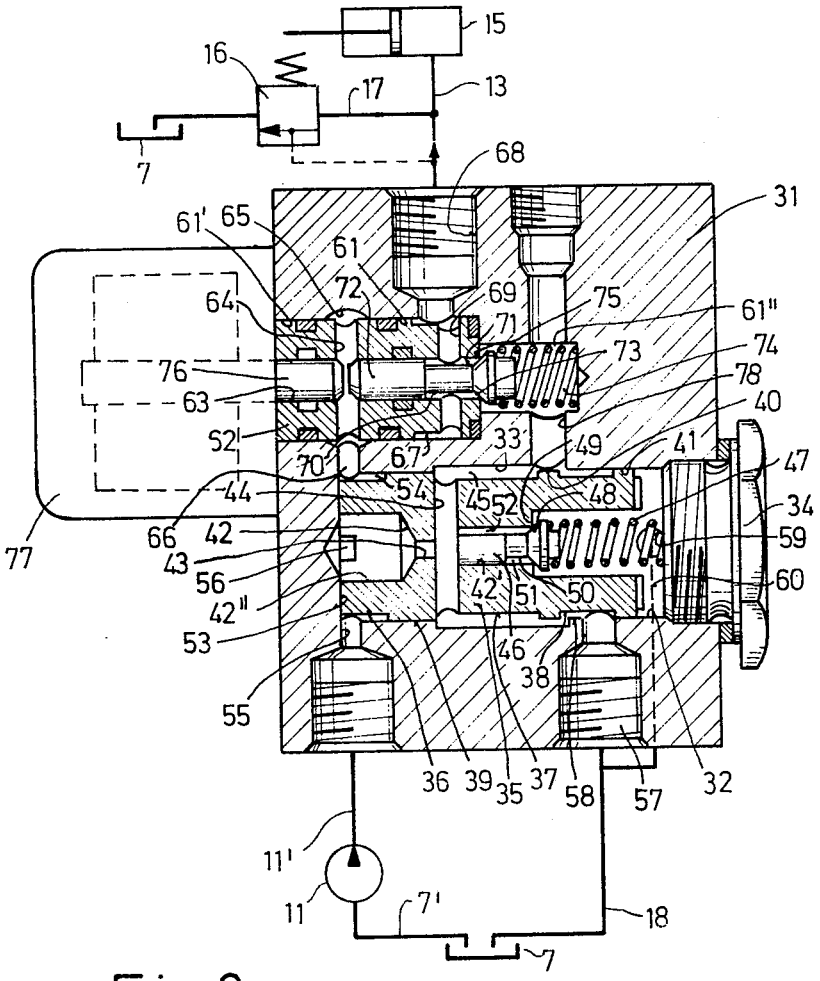
FIG. 3 illustrates in a sectional view a further embodiment of the invention.

Coming, finally, to the embodiment illustrated in FIG. 3 it is pointed out that this represents a particularly advantageous combination of a venting means according to the present invention with a control for a single-acting hydraulic cylinder and piston unit. In this embodiment a housing 31 has a bore 32 provided with an annular enlargement 33 and closed to the exterior by a screw 34.

A slidable valve member 35 is provided, having an end remote from the screw 34 and formed with a projection 36, the diameter of which is smaller than that of three annular circumferential surfaces 39, 40 and 41 which are tightly and slidably guided in the bore 32. The surfaces 39, 40 and 41 are separated by annular grooves 37 and 38.

The member 35 is provided with a longitudinal stepped bore 42 formed with a throttling gap 43. A transverse bore 44 communicates the bore 42 with an annular space 45 defined between the groove 37 and the enlargement 33. In that portion 42' of the bore 42 which is adjacent the bore 44 in the direction towards the screw 34, there is accommodated a valve body 46 of a pressure limiting valve. A pressure spring 47 is provided which presses the valve body 46, over a conical seating surface 48 thereof, against a valve seat 49 which is formed in the stepped bore 42. The opposite end of the spring 47 abuts against the screw 34. Ahead of the conical sealing surface 48 the valve body 46 is provided with an annular groove 50, thus forming an annular space 51 located before the valve seat 49 and communicating with the transverse bore 44 via a channel 52. The channel 52 is obtained by flattening a portion of the valve body 46.

When the pump 11 is not in operation, the spring 47 presses the member 35 against the bottom wall 53 of the bore 32. This results in the provision of an annular space 54 between the wall of the bore 32 and the projection 36. A bore 55 communicates with the space 54 and is connected in turn via the conduit 11' with the pressure side of the pump 11. The surface 39 assures that the space 54 is at all times separated from the space 45. In the position of the member 35 that is illustrated in FIG. 3, grooves 56 communicate the space 54 with the enlargement 42'' of the bore 42 which is located ahead of the throttling gap 43. The bore 32 also communicates with a bore 57 for the outflow of hydraulic fluid, and the bore 57 is connected via the conduit 18 with the reservoir 7 which, of course, is not under any pressure other than the atmospheric pressure. The communication between bore 57 and bore 32 is such that a sealing surface 58 is left with respect to the annular space 45.

If, now, the member 35 abuts against the bottom wall 53 of the bore 32, then the annular space 45 is in communication with the bore 57 via the annular groove 38. A bore 59 has an opening which communicates with the bore 32 in such a manner that in all positions of the member 35 the hydraulic fluid can flow from a space 60 located between the screw 34 and the adjacent endface of the member 35, into the reservoir 7.

An additional stepped bore 61 is provided, extending parallel to the bore 32 and having a portion 61' of larger diameter than the remainder of the bore 61. In the portion 61' there is mounted stationarily a sleeve 62 provided with a longitudinal passage 63 which communicates via a transverse bore 64 with an annular groove 65 provided in the bore 61. The groove 65 in turn is in communication with the bore 32 via a channel 66 which communicates in the region of the space 54 with the bore 32. An annular groove is provided on the periphery of the sleeve 62 and designated with reference numeral 67; it cooperates with a bore 68 which in turn communicates with the single-acting hydraulic cylinder and piston unit 15 via the conduit 13.

The return flow conduit 17 has the pressure limiting valve 16 interposed in it, as in the preceeding embodiments; it connects the conduit 13 with the reservoir 7.

A transverse bore 69 connects the annular groove 67 with an annular space 70 which is delimited by the wall of the bore 63 and an annular groove 71 provided on the valve body 72 of a blocking valve, which valve body 72 is arranged in the passage 63 of the sleeve 62. The valve body 72 is pressed with its conical sealing surface 73 against the valve seat 75 provided on the sleeve 62 by a spring 74 which is located in the portion 61'' of the bore 61, that is the portion having the smaller diameter. The valve body 72 extends to the first transverse bore 64.

A somewhat diagrammatically shown electromagnet 77 is seen at the left-hand side of FIG. 3, where it is mounted on the housing 31. It has a pin 76 which extends from the other end of the sleeve 62 into the passage 63 thereof, to the region of the transverse bore 64, so that only a small gap remains between the valve body 72 and the juxtaposed end of the pin 76. The bore portion 61'' accommodating the spring 74 is connected with the bore 32 via a bore 78 which communicates with the annular space 45.

The operation of the embodiment in FIG. 3 will now be described:

When the pump 11 is not operating, the member 35 is displaced towards the left (in the Figure) against the bottom wall 53 of the bore 32 by the action of the spring 47. Thus, the annular space 45 can communicate with the bore 57 via the annular groove 38. It is important that the diameter of the member 35 be so selected that the pressure of hydraulic fluid on that end of the member 35 facing away from the spring 47 is capable of almost establishing equilibrium with the force exerted by the spring 47.

When the pump 11 is actuated, especially when the hydraulic system is placed into operation for the first time, then the pump will draw air which is in the suction conduit 7'. The air is, of course, followed by the hydraulic fluid which is subsequently drawn into the conduit 7' from the reservoir 7, and this fluid displaces the air ahead of it through the conduit 11' and into the bore 55. Froom there it enters into the annular space 54 and flows through the groove 56, the throttling gap 43, the transverse bore 44, the annular space 45 and the annular groove 38 into the bore 57 and into the reservoir 7. The throttling gap 43 does not constitute any particular flow resistance to the air, as is of course true also in the embodiments of FIGS. 1 and 2, so that the member 35 remains in the position illustrated and is not displaced.

However, when the hydraulic fluid reaches the throttling gap, the pressure differential which there develops causes a force which displaces the member 35 counter to the residual force (the force which is not compensated to equilibrium) of the spring 47, in the right-hand direction as seen in FIG. 3. When the surface 40 of the member 35 overlaps the surface 58, the return flow to the reservoir 7 via the bore 52 is blocked. Of course, it will take a brief time before the member 35 reaches this position, and in this time a small amount of pressure fluid can flow via the bore 57 to the reservoir 7, but this is of no consequence and does not disadvantageously influence the operation.

From the annular space 45 the hydraulic pressure fluid flows via the bore 78 into the bore portion 61'', and from the space 54 through the channel 66, and the transverse bore 64 into the bore 63. Due to the pressure differential between the surfaces of the valve body 72 which are contacted by the fluid, the valve body is displaced towards the right counter to the force of the spring 74, so that the fluid can flow through the annular space 70, the transverse bore 69, the bore 68 and the conduit 13 to the cylinder and piston unit 15, whereupon the piston thereof moves. When the piston of the unit 15 has reached its end position, then the pressure downstream of the throttling gap 43 will rise sufficiently for the valve body 46 to be displaced towards the right in FIG. 3, counter to the force of the spring 47, so that pressure fluid can enter into the space 60 behind the member 35 and flow via the bore 59 back to the reservoir 7.

If for any reason the pump 11 is now shut down, for instance if it is desired that the piston of the unit 15 is to remain in its end position, then a pressure equilibrium developes between the spaces at opposite sides of the throttling gap 43. As a result of this the same pressure will act upon the two opposite ends of the valve body 72, so that the same can be displaced by the spring 74 against the valve seat and will block return flow from the unit 15, because the pressurized surfaces in the space 70 are so dimensioned that no pressure forces can develop which could influence the movement of the valve body. The spring 47 now displaces the member 35 towards the left, thus assuring that the surface 40 exposes the connection from the space 45 to the bore 57.

If the piston of the unit 15 is to be made to move to the opposite direction from the one previously described, then the valve body 72 is displaced towards the right by the pin 76 of the electromagnet 77, so that the pressure fluid will flow under the influence of the restoring force acting upon the piston of the cylinder 15, through the bores 68, 69, 61'' and 78, the space 45, the annular groove 38 and the bore 57, and finally into the reservoir 7. Interrupting of the restoring movement is effected by moving the pin 76 of the magnet 77 towards the left, which permits the spring 74 to displace the valve body 72 towards the left against the valve seat and to interrupt the flow of hydraulic pressure fluid into the reservoir 7.

It is clear that in this embodiment, as in those of FIGS. 1 and 2, the venting of entrapped air in the system will take place automatically every time the pump 11 is started, and it can be repeated as often as necessary or desired and will always operate fully automatically.

It will be understood that each of the elements described above, or two or more together, may also find a useful application in other types of constructions differing from the types described above.

While the invention has been illustrated and described as embodied in a hydraulic system with air-venting arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended:

1. In a hydraulic system, a combination comprising a source of pressurized hydraulic fluid; a user; a valve housing having a bore defined by an inner surface; a valve body mounted in said bore and subdividing the same into an inlet compartment and an outlet compartment, said valve body having an outer circumferential surface in sliding sealing contact with said inner surface and a channel forming a throttling gap and establishing the only communication between said compartments; inlet means communicating said inlet compartment with said source; outlet means communicating said outlet compartment with said user; venting means communicating said outlet compartment with the ambient atmosphere; biasing means urging said valve body toward an open position in which said outlet compartment communicates with said venting means, the throttling effect of said throttling gap resulting in a pressure differential across and displacement of said valve body into a sealing position in which said outer circumferential surface prevents communication between said outlet compartment and said venting means so that the hydraulic fluid passes from said outlet compartment through said outlet means to said user; control valve means in said outlet means operative for establishing communication between said outlet compartment and said user when said valve body is in said sealing position thereof and for preventing such communication upon return of said valve body into said open position in response to cessation of flow of the hydraulic fluid through said throttling gap; and means for actuating said control valve means so as to establish communication between said user and said outlet compartment when said valve body is in said open position thereof so as to vent the spent hydraulic fluid through said venting means.

2. A combination as defined in claim 1, wherein said user is a hydraulic cylinder-and-piston unit.

3. A combination as defined in claim 1, wherein said source comprises a hydraulic fluid reservoir.

* * * * *